United States Patent [19]

Raue et al.

[11] 4,421,352

[45] Dec. 20, 1983

[54] LOOP AS WELL AS SLING FORMED THEREOF OR LOOP MAT FORMED THEREOF

[75] Inventors: Karl M. Raue, Falsterbo, Sweden; Hans-Otto von Danwitz, Karst, Fed. Rep. of Germany

[73] Assignee: Spanset Inter AG, Basel, Switzerland

[21] Appl. No.: 302,474

[22] PCT Filed: Jan. 21, 1981

[86] PCT No.: PCT/EP81/00005

§ 371 Date: Sep. 9, 1981

§ 102(e) Date: Sep. 9, 1981

[87] PCT Pub. No.: WO81/02151

PCT Pub. Date: Aug. 6, 1981

[30] Foreign Application Priority Data

Jan. 21, 1980 [SE] Sweden ..... 8000451
Oct. 30, 1980 [DE] Fed. Rep. of Germany ... 8028911[U]

[51] Int. Cl.[3] ..... B66C 1/12

[52] U.S. Cl. ..... 294/74; 428/58; 428/162; 428/163; 428/172; 428/178; 428/184; 428/232

[58] Field of Search ..... 294/74; 428/58, 162, 428/163, 172, 178, 184, 232

[56] References Cited

U.S. PATENT DOCUMENTS

| | | | |
|---|---|---|---|
| 2,960,365 | 11/1960 | Meisen | 294/74 |
| 3,122,806 | 3/1964 | Lewis . | |
| 3,290,083 | 12/1966 | Norton | 294/74 |
| 3,622,025 | 11/1971 | Petersen | 294/74 |
| 3,840,262 | 10/1974 | Foster et al. | 294/74 |
| 4,232,619 | 11/1980 | Lindahl | 294/74 |

FOREIGN PATENT DOCUMENTS

| | | | |
|---|---|---|---|
| 798197 | 11/1968 | Canada | 294/74 |
| 2038480 | 2/1972 | Fed. Rep. of Germany | 294/74 |
| 2356868 | 5/1974 | Fed. Rep. of Germany . | |
| 2348713 | 12/1974 | Fed. Rep. of Germany . | |
| 2453838 | 5/1976 | Fed. Rep. of Germany . | |
| 2205468 | 5/1974 | France | 294/74 |
| 1067259 | 5/1967 | United Kingdom . | |
| 1504376 | 3/1978 | United Kingdom | 294/74 |
| 2050998 | 1/1981 | United Kingdom | 294/74 |

*Primary Examiner*—James C. Cannon
*Attorney, Agent, or Firm*—Spencer & Frank

[57] ABSTRACT

A loop formed of a core in the form of one or a plurality of yarn skeins and a seamlessly woven protective sheath which encloses the entire core with considerable play is provided with one or two diagonally oppositely disposed woven flat ribs so as to cause the protective sheath to take on a flat oval cross-sectional configuration even before a load is attached and/or to serve as the support for a connecting seam for two juxtaposed loop strands. The seams may also be used to fasten an abrasion protection cover. The seams may likewise be used to connect a plurality of loops or slings to form a loop mat.

19 Claims, 8 Drawing Figures

Fig. 1
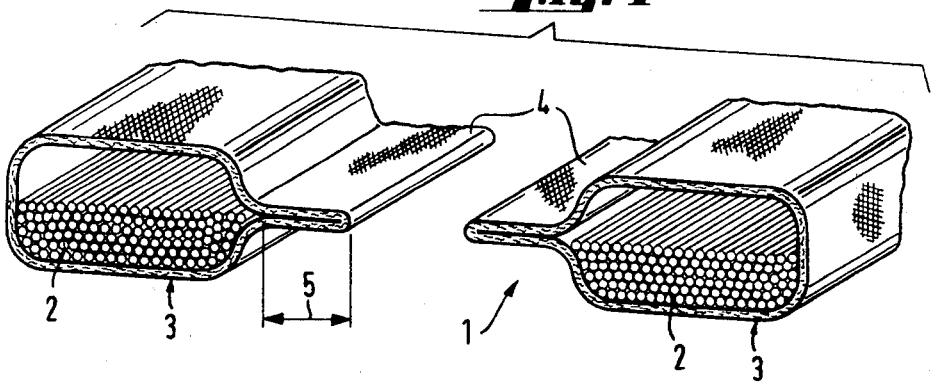
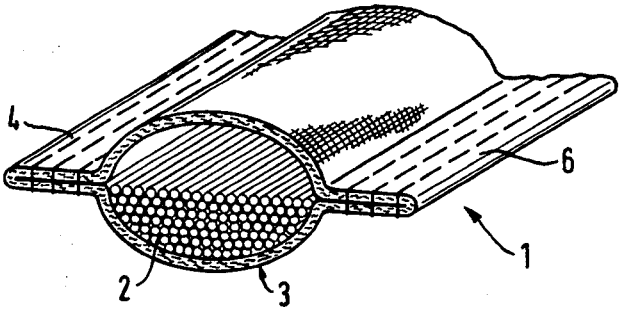
Fig. 2
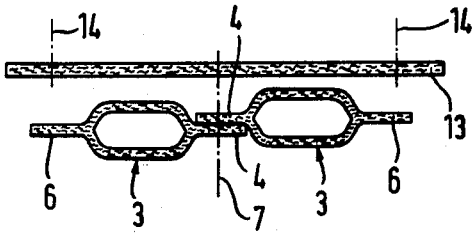
Fig. 3
Fig. 4
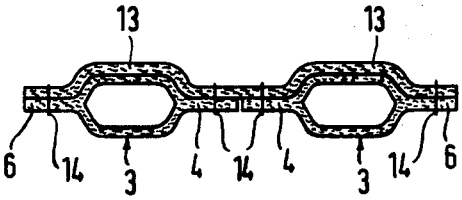

LOOP AS WELL AS SLING FORMED THEREOF OR LOOP MAT FORMED THEREOF

BACKGROUND OF THE INVENTION

The invention relates to a circular or endless loop of the type comprising a core in the form of a plurality of yarn skeins and a seamless, woven protective sheath which encloses the entire core with considerable play. A loop of this type is disclosed in German Application DE-B 2,129,837.

It is significant for such loops that the core fills the cross sectional area of the protective sheath only to about 50 to 70 percent so that such loops are thus freely movable relative to the protective sheath and that the individual turns of the core are likewise not fixed relative to the protective sheath and to one another. Only in this way is it possible for the different turns to move relative to one another under load and to assume the same length due to the load so that overloading of an individual thread turn is avoided.

One feature of such a loop is also that in the unstressed state the protective sheath is somewhat longer than the core so that the protective sheath is lightly folded along the core.

The manufacturing process for such a loop is described in greater detail in German Application DE-B 2,129,837.

For this purpose, the prefabricated protective sheath is pushed longitudinally over a tube which is continuously open over a circumferential region of about 180°, i.e. has the shape of a trough; the sheath is thus pushed together longitudinally or upset, respectively, to less than half its length so that the sheath encloses the tube in an extensively folded manner. Then a thread of a textile yarn, of plastic or the like is pulled longitudinally through the interior of the tube or through the interior of the protective sheath, respectively. The pulled-through end of the yarn is then returned along the outside of the protective sheath to the insertion end and is again pulled longitudinally through the protective sheath or through the trough, respectively. This process is repeated many times in such a manner that a yarn skein is formed which comprises many circular layers of but a single thread. Due to the large number of juxtaposed layers of yarn which pass through the protective sheath, it is not necessary to knot or connect the ends of the yarn together. Rather, the ends may remain loose without thus adversely affecting the tensile strength of the yarn skein. After producing the yarn skein in such a manner, the protective sheath is pushed away from the trough in the longitudinal direction toward the yarn skein or skeins. The yarn skein is then removed from the trough so that it also is free. Then the upset protective sheath is pushed over the entire circumference of the yarn skein. Its ends are pushed together and preferably sewn to each other. The protective sheath has such an initial length that in its final state it is still somewhat longer than the yarn skein or skeins which it encloses. Thus it encloses the yarn skein or skeins with a slight amount of folding.

A significant feature of such known loops is that in their regions where they contact the crane hook or the load they have a very flat-oval cross-sectional configuration in which the individual threads of the yarn skein or skeins lie essentially next to one another and not on top of one another. This fact in particular takes care of uniform load distribution to the individual turns of the yarn skein.

SUMMARY OF THE INVENTION

It is the object of the invention to design a loop of the above-mentioned type in such a manner that the very flat cross-sectional configuration which develops under load, particularly in the contact regions, is given as much as possible already by the structure of the loop or that the assumption of such a flat cross-sectional configuration is stimulated as much as possible even before the onset of a load, and particularly under load, by structural design.

In one embodiment of the invention, at least one flat rib is woven to the protective sheath so as to project laterally from the cross section of the sheath. In another embodiment, an additional supporting effect is achieved by providing a flat rib at each of two diagonally oppositely disposed sides of the sheath cross section. In the latter embodiment the flat ribs can theoretically also be formed by sewing together the edge regions of two superposed bands so as to form a tube. However, the flat ribs can also be easily produced to advantage already during the production of the fabric of the protective sheath. In this connection it must be considered that in a weaving technology sense a tube is two-layer fabric whose two layers are not connected together. Known two-layer belt webbing is produced in a similar manner; such webbing differs from woven tubes only in that their two layers of fabric are connected together by means of a binding chain worked in during weaving. Such dual-layer webbing can also be used in the invention. According to the invention, the above-mentioned flat rib or ribs are formed in that during weaving of the protective sheath a binding chain is worked in or permitted to form in the desired flat rib regions. The regions in the dual-layer fabric which are free of the binding chain then form the actual tube.

The flat ribs also have the effect of a bilateral wear protection strip.

The invention further relates to a sling formed of such a loop. Slings are loops in which two facing loop portions are combined or connected together, respectively, in an intermediate region between two hanging eyes. The further invention now comprises making the mutual connection of the two loop parts by sewing together their facing flat ribs. In this way it is assured that the needle used to produce the connecting seam cannot pierce the yarn skein and damage its individual threads. It is further assured in this way that the seam will not interfere with the free mobility of the individual threads with respect to the protective sheath and relative to one another, which is so important for the operability of the loop or the sling.

The design of the sling according to the invention makes possible the application of an abrasion protection cover—also called the working surface—likewise without damaging the supporting yarn skein or without impeding the operational capability of the loop or yarn coil.

The invention further makes it possible, to fasten protective sheaths for the hanging eyes of the sling in a simple manner and secure against displacement.

It is also possible, in a simple manner, to produce a loop mat by connecting together, according to the invention, a plurality of juxtaposed loops or slings, similar to those used, for example, for the installation of pipelines.

BRIEF DESCRIPTION OF THE DRAWINGS

The subject matter of the invention will be illustrated in an exemplary manner with the aid of the drawing figures. It is shown in:

FIG. 1, a cross-section through the loop according to the invention;

FIG. 2, a cross-section through a section of a loop of modified design compared to the embodiment of FIG. 1;

FIG. 3, a cross-section of a sling produced from a loop according to FIG. 2 with abrasion protection cover sewn on if required;

FIG. 4, a modified embodiment of the sling according to FIG. 3;

DESCRIPTION OF THE PREFERRED EMBODIMENTS

Figure 5:
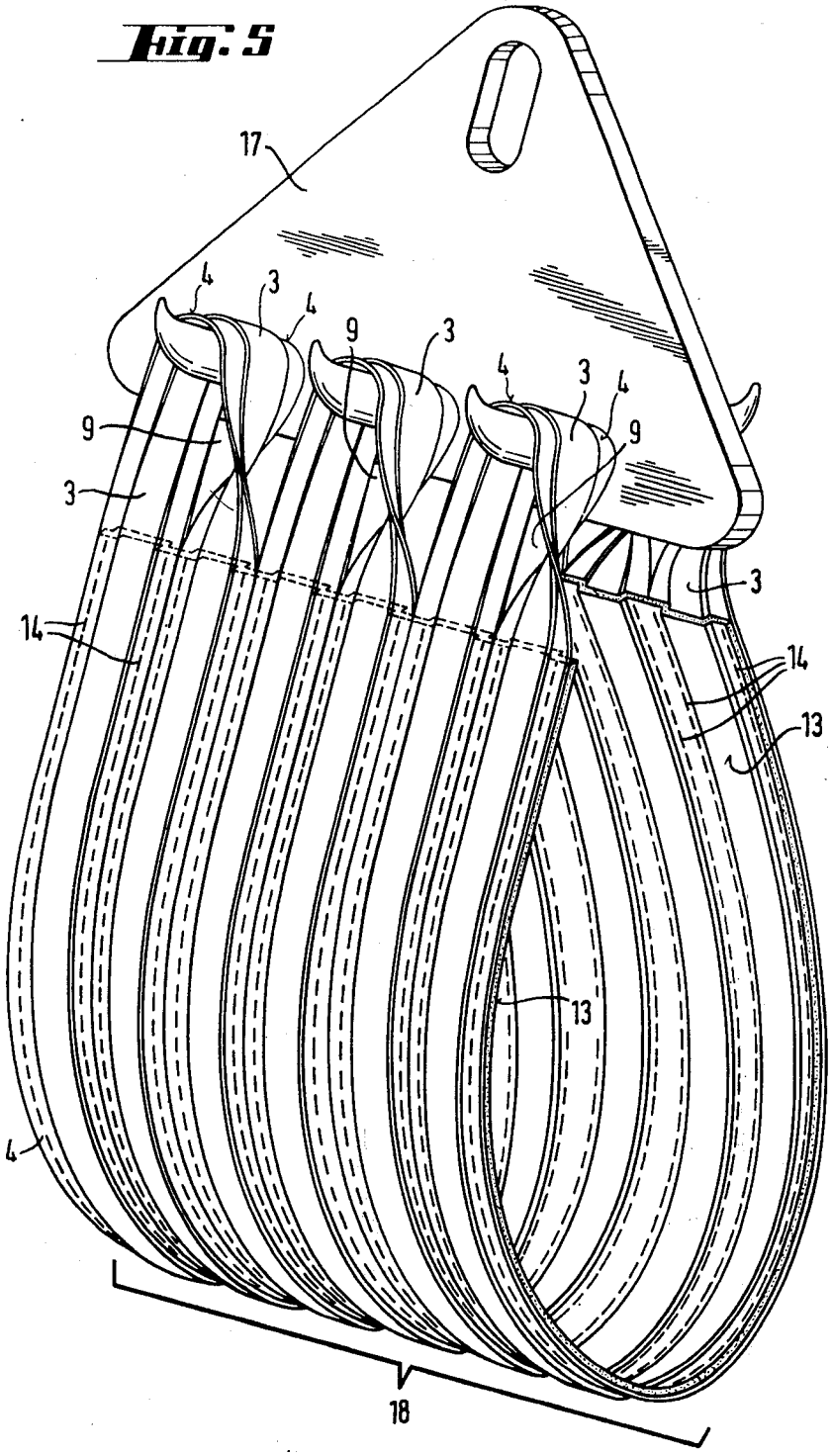
FIG. 5, a perspective view of a loop mat produced from loops designed according to the invention.
Figure 6:
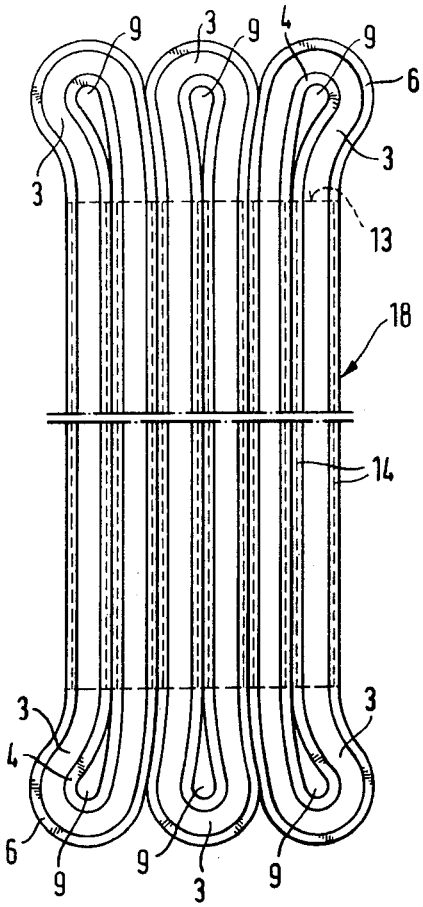
FIG. 6, a plan view of the loop mat.

The loop marked as a whole with the reference numeral 1 includes a core 2 in the form of one or a plurality of yarn skeins and a woven protective sheath 3 without seam which encloses the entire core 2 with considerable play. At least one flat rib 4 is woven to the protective sheath 3 and projects laterally from its cross section. The yarn skein of the core 2 comprises endless plastic threads which have been drawn into the sheath 3.

During weaving of the sheath, the flat rib 4 is formed in a simple manner in that a binding chain is worked into the dual layer fabric over its width 5 in a manner known to every person skilled in the weaving art.

The loop 1 shown in FIG. 2 is provided with a woven-on flat rib 4 or 6, respectively, at two diagonally opposite sides of the sheath cross section.

Figure 7:
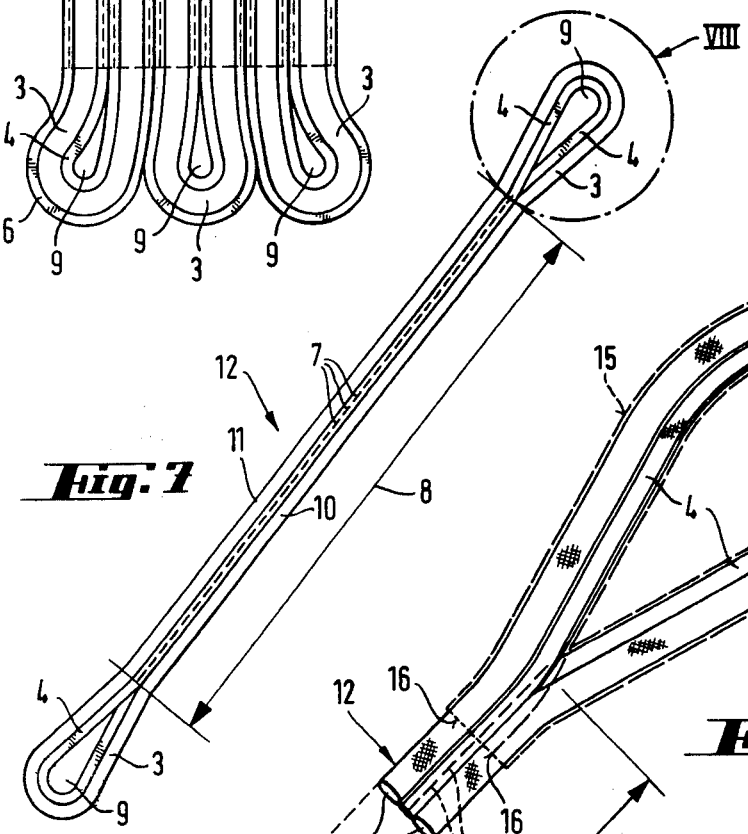
FIG. 7, a perspective view of a sling produced from a loop according to FIG. 1.

In the sling 12 shown schematically in cross section in FIG. 3, the contacting flat ribs 4 of two juxtaposed parts of the protective sheath 3 are placed one on top of the other and are sewn together by seam 7. As shown in FIG. 7, the sling 12 is formed in that in the intermediate region 8 between the hanging eyes 9 two contacting loop sections 10, 11 are combined.

In the intermediate region 8, an abrasion protection cover 13 in the form of, for example, a textile band, may be sewn or fastened, respectively, by means of seams (7, 14) to at least one of the flat ribs 4, 6 on the working side of the sling 12.

Figure 8:
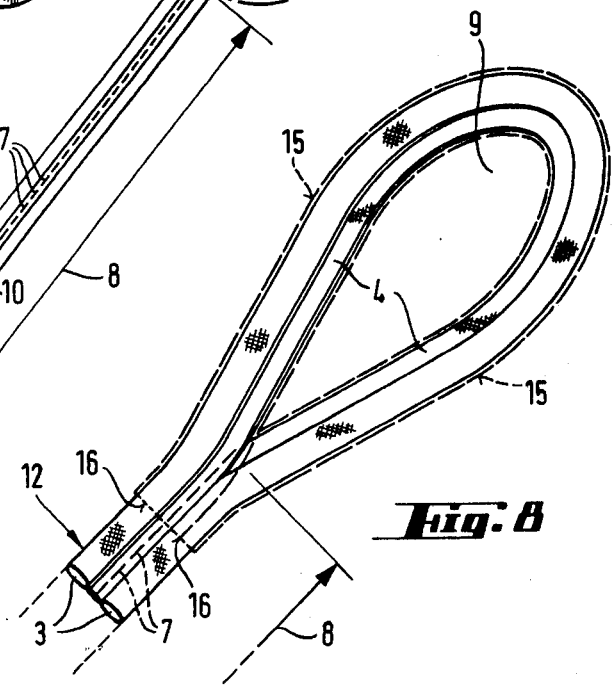
FIG. 8, an enlarged detail view of the upper hanging eye according to arrow VIII in FIG. 7 with a section of protective sheath sewn into the ends of the flat rib seam.

The protective sheath 3 of a loop 1 or of a sling 12, respectively, may have pushed over it two, in particular seamless sections of a covering tube to cover the sheath sections forming the hanging eyes 9 as shown in dashed lines as covering tube sections 15 in FIG. 8. The ends 16 of these covering tube sections project into the interstice 8 and are there sewn to the flat ribs 4 of the protective sheath 3.

FIG. 5 shows a loop mat 18 which was produced by using three loops 3 or slings 12, respectively, which has been hung by means of hanging eyes 9 into a lifting harness 17. The loops 3 here lie next to one another in the manner of slings 12. They are connected together by means of seams 7 or 14, respectively, which again are made in the flat bars 4 or 6, respectively.

For the hanging eyes 9 of the sling 12 which are to be protected by the covering tube sections 15, the covering tube sections 15 are pushed onto the protective sheath 3 before the yarn skein is pulled in. As already explained, the making of the yarn skein is described in detail in German Laid-Open Patent Application [Offenlegungsschrift] No. 2,716,056.

We claim:

1. A sling comprising:

a core formed of at least one yarn skein;

a seamless, woven protective sheath having internal and external surfaces, said sheath being in the form of an endless tube which entirely encloses said core, the threads of said skein being arranged in said tube to be movable relative to one another and the internal surface of said sheath; and at least one flat rib woven to said sheath along its entire length and projecting outwardly from the external surface thereof;

wherein said sheath and rib woven thereto together have first and second section juxtaposed with respect to each other to form an intermediate region of the sling having opposite ends, with the portion of the rib associated with said first section overlapping and connected to a portion of the rib associated with said second section; and said sheath and rib woven thereto together have third and fourth sections each connected to a respective one of said ends and forming respective hanging eyes.

2. A sling according to claim 1, wherein said sheath and said at least one flat rib are comprised of a single fabric having two layers, said two layers having opposing inner surfaces connected together which form said at least one rib.

3. A sling according to claim 1, wherein the length of said sheath is greater than the length of said core.

4. A sling according to claim 1 wherein said core partially fills said tube.

5. A sling according to claim 1, wherein two flat ribs are woven to said sheath along its entire length and each project outwardly from the external surface thereof in opposite directions.

6. A sling according to claim 5, wherein said sheath and said flat ribs are comprised of a single fabric having two layers, said two layers having two sets of opposing inner surfaces connected together which form said ribs.

7. A sling according to claim 5, and further including a stitching seam connecting together said overlapping rib portions.

8. A sling according to claim 5, wherein said intermediate region has a working side, and further including an abrasion cover for covering said working side, said abrasion cover being connected to at least one of said flat ribs on the working side of said sling.

9. A sling according to claim 8, and further including a stitching seam connecting said abrasion cover to said at least one flat rib.

10. A sling according to claim 8, and further comprising two covering tube sections each encasing a respective one of said third and fourth sections.

11. A sling according to claim 1, and further including a stitching seam connecting together said overlapping rib portions.

12. A sling according to claim 1, wherein said intermediate region has a working side, and further including an abrasion cover for covering said working side, said abrasion cover being connected to said at least one flat rib on the working side of said sling.

13. A sling according to claim 12, and further including a stitching seam connecting said abrasion cover to said at least one flat rib.

14. A sling according to claim 8, and further comprising two seamless covering tube sections each encasing a respective one of said third and fourth sections which form said hanging eyes, each said covering tube section having ends protruding into said intermediate region and connected to said flat rib portions.

15. A sling according to claim 14, and further including a stitching seam connecting said covering tube section ends to said flat rib portions.

16. A mat comprising:

a plurality of cores each formed of at least one yarn skein;

a plurality of seamless, woven protective sheaths each having internal and external surfaces, each said sheath being in the form of an endless tube which entirely encloses a respective one of said cores, the threads of each said skein being arranged in a respective one of said tubes to be movable relative to one another and the internal surface of the respective sheath;

a plurality of flat ribs woven to a respective one of said sheaths along its entire length and projecting outwardly from the external surface thereof;

wherein a section of each said sheath and rib woven thereto is arranged to be in juxtaposition with a section of another said sheath and rib woven thereto so that the respective ribs of such juxtaposed sections overlap each other and are connected together.

17. A mat according to claim 16, and further including a stitching seam connecting together said ribs which overlap each other.

18. A mat according to claim 16, wherein said mat has a working side, and further including a cover extending over the entire width of said mat and being connected to said flat ribs on said working side, and further including a stitching seam connecting together said ribs through said cover.

19. A mat according to claim 16, wherein said cover is an abrasion cover or a woven webbing.

* * * * *